United States Patent [19]

Schwartz

[11] Patent Number: 5,001,852

[45] **Date of Patent: * Mar. 26, 1991**

[54] TAP-SHOE TAP-SOUND AMPLIFYING DEVICE

[76] Inventor: Richard Schwartz, 343-7th Ave., New York, N.Y. 10001

[ * ] Notice: The portion of the term of this patent subsequent to Feb. 26, 2004 has been disclaimed.

[21] Appl. No.: 656,904

[22] Filed: Oct. 2, 1984

[51] Int. Cl.[5] ..... A43B 5/12; H04M 1/05; H04B 1/034

[52] U.S. Cl. ..... 36/139; 36/8.3; 168/4; 381/87; 455/100

[58] Field of Search ..... 36/8.3, 136, 139, 8.5; 381/87, 122; 179/157; 455/100; 168/4

[56] References Cited

U.S. PATENT DOCUMENTS

| | | | |
|---|---|---|---|
| 2,320,560 | 6/1943 | Braddock | 46/191 |
| 2,940,184 | 6/1960 | Malone | 36/139 |
| 3,702,999 | 11/1972 | Gradisar | 340/272 |
| 3,999,611 | 12/1976 | Bucazo | 168/4 |
| 4,043,241 | 8/1977 | Liu | 84/1.01 |
| 4,233,845 | 11/1980 | Pratt, Jr. | 119/29 |
| 4,402,147 | 9/1983 | Wu | 36/136 |
| 4,463,506 | 8/1984 | Isackson | 36/8.3 |

FOREIGN PATENT DOCUMENTS

| | | | |
|---|---|---|---|
| 1565725 | 5/1969 | France | 36/8.3 |

*Primary Examiner*—Werner H. Schroeder
*Assistant Examiner*—Steven N. Meyers

[57] ABSTRACT

In a preferred embodiment, a pair of tap shoes each having toe and heel taps, associated with each tap there being an audio-pickup transducer mounted one adjacent each tap, connected by signal-carrying wiring to a common electronic radio-wave transmitter and power-source mechanism that receives and sends the signal received from the respective transducers to a radio-wave receiver and amplifying and speaker mechanism spaced-away from the tap shoes such that tapping sounds of the taps on a hard surface are received, amplified and broadcast through speakers.

9 Claims, 3 Drawing Sheets

FIG. 1
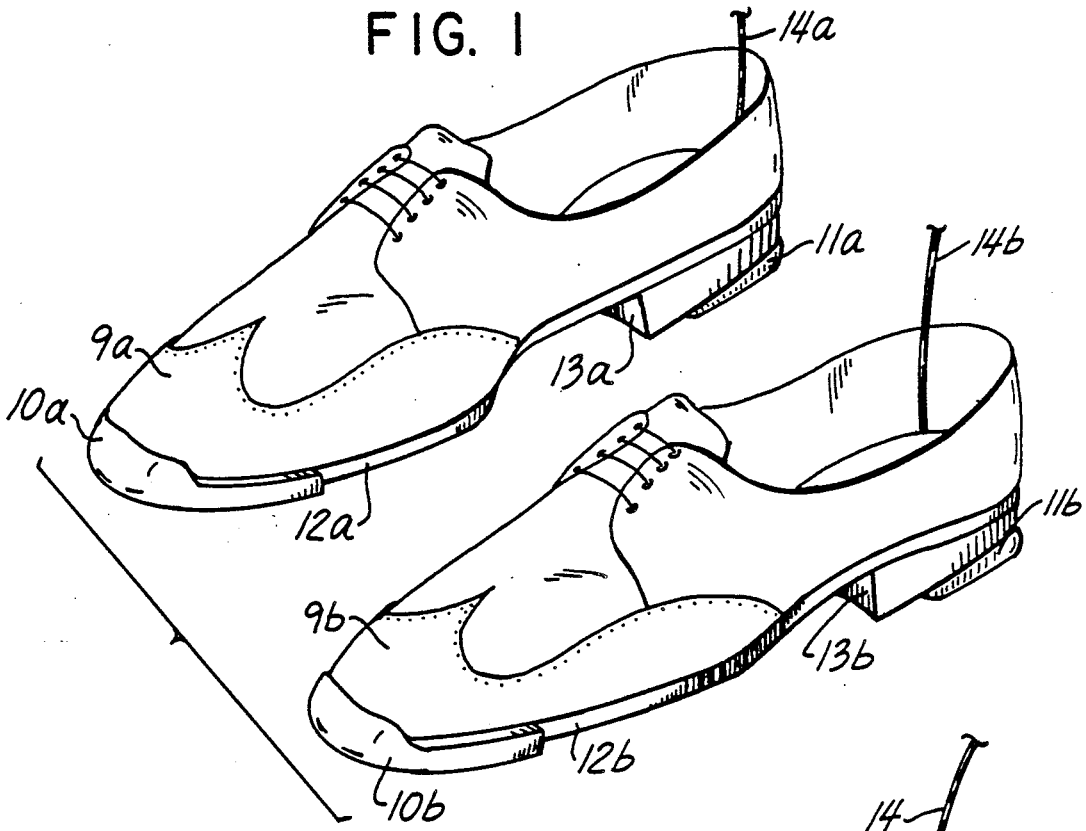
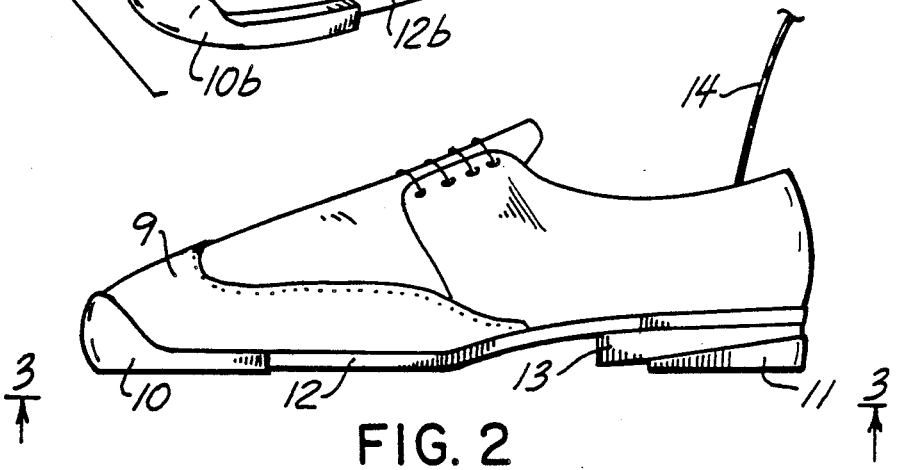
FIG. 2
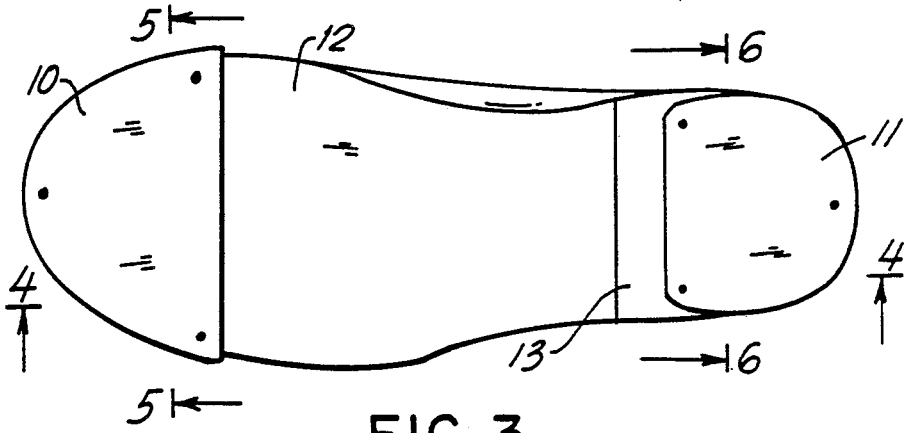
FIG. 3

FIG. 7B
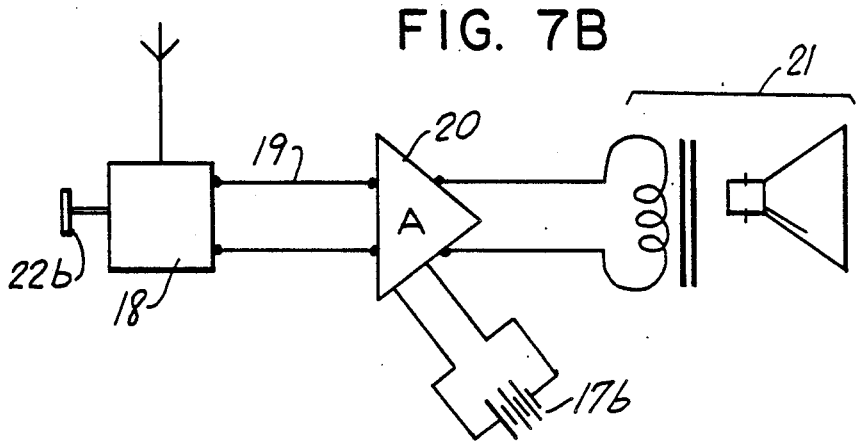
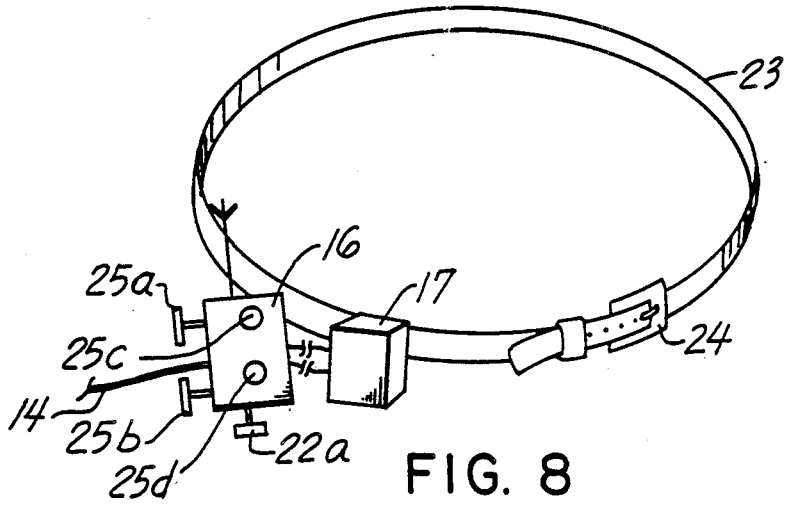
FIG. 8
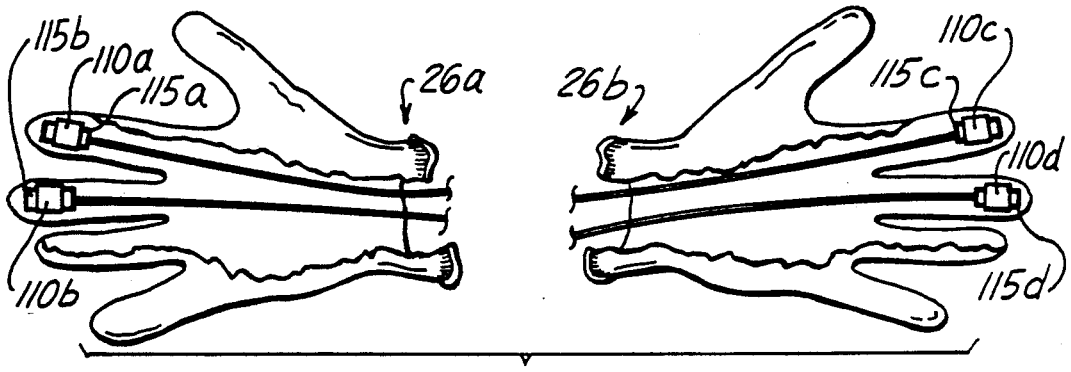
FIG. 9

TAP-SHOE TAP-SOUND AMPLIFYING DEVICE

This invention is directed to a novel tap shoe and tap-sound amplification unit.

BACKGROUND OF THE INVENTION

Prior to the present invention, there has been an ever-increasing problem that developed for tap dances as polular music as played on or through large and powerful amplifying systems produced louder and louder music making the sound of tapping tap-shoes virtually impossible to discern or hear as a part of the beat of the music. Such problem has substantially reduced the extent to which tap dancers may be a part of various musical performances, and making special compensations necessary in the playing or performance of musics in order to accomodate the utilization of a tap dancer one or more. The problem relates not only to live performances, but to the now controlling media of television, drastically limiting the financial possibilities open to tap dancers.

OBJECTS OF THE INVENTION

Accordingly, a primary object of the invention is to overcome one or more problems and difficulties of the nature noted above.

Another object is to obtain a combination of tap shoes with appropriate amplification mechanism as to make tap-shoe tapping sufficiently loud as to be heard and appreciated as a part of the music and/or musical beat.

Another object is to obtain a tap-shoe device of a nature that a tap-dancer may move freely uninhibited by devices, and still with normal ease make his shoe-tapping heard during and as a part of loudly amplified music.

Another object is to obtain a tap-shoe device by which the tapping volume of tapping-sound may be adjusted to any of appropriate levels to match the loudness or softness of accompanying music played by a band, orchestra, piano, or the like.

Another object is to obtain a shoe-tap device for mounting on tapping shoes, including a mechanism for amplification of tapping sounds produced by the taps on a hard surface.

Another object is to obtain such shoe-tap device and/or shoes mounting the same, inclusive of radio wave sending and receiving mechanisms for amplification and speaker reproduction away from the tap dancer and his tapping shoes.

Another object is to obtain a portable transmitter with wearer attachment suitable for transmission of radio signals carrying tapping sounds from the tapping shoes of a tap dancer.

Other objects become apparent from the preceding and following disclosure.

One or more objects are obtained by the invention as set-forth below and illustrated in accompanying drawings intended to facilitate understanding but not unduly limit the scope of the invention by these merely illustrative examples.

SUMMARY OF THE INVENTION

Broadly the invention may be described as a tap of the type mountable on a tapping shoe, mountable with or in combination with a suitable audio-pickup transducer having circuitry for delivering tapping-sound signals pickedup thereby to an amplifier, and including such amplifier together with a speaker circuitry and speaker for reproducing the amplified tapping sound.

Preferably the tapping shoe(s) is/are single and as a pair a part of the inventive combination, having the taps and transducer(s) mounted on the soles thereof in conventional mounting positions.

The transducer is preferably mounted either within or beneath the sole of the shoe or within the tap itself.

Preferably the transducer is mounted with one thereof in juxtaposition to the tap near the toe of the shoe, and another one thereof in juxtaposition to the tap on the heel of the shoe, for preferably both of a pair of tapping shoes.

A preferred combination is a transducer on a tap, for glove or shoe.

Preferably the circuitry transmitting the electrical signals from the transducer(s) includes a radio-wave transmitter and a radio-wave receiver and amplifier for receiving and amplifying the signal(s) transmitted by the radio-wave transmitter such that the amplified transmitted and received signal reproduces the tapping sound at a location spaced away from the location or cite of the tap dancing of the dancer(s) wearing the tapping shoe(s) transmitting the signals.

As a part of the transmitting mechanism in combination therewith, there is an appropriate power source, such as portable batteries for example.

Preferably the transmitter and power source are portably mounted by appropriate suspension mechanism mountable on the body and/or clothing, such as by a belt and belt buckle.

The volume of amplification is preferably variable by manual control of the transmitter and/or the receiver units. Preferably, thus the dancer himself may have control of loudness in order to vary the same in accord with his own artistic desires and abilities, while also there may optionally and preferably be volume control also associated with the receiver and/or amplification unit(s).

Preferably the transducer is of a tape-type, as desired and/or as is presently commercially available typically under the name of C-ducer (trademark), for example.

Likewise, conventional desired and/or presently commercially available transmitter(s) and receiver(s).

FIGURES

FIG. 1 illustrates a pair of novel tapping shoes that include the taps and transducer and wiring shown in-part, shown in front perspective top view.

FIG. 2 illustrates typically one of such shoes of FIG. 1, shown in a side view thereof, better showing the taps thereon and a portion of the wire circuitry extending therefrom.

FIG. 3 illustrate typically a bottom plan view of the shoe of FIG. 2.

Figure 7A:
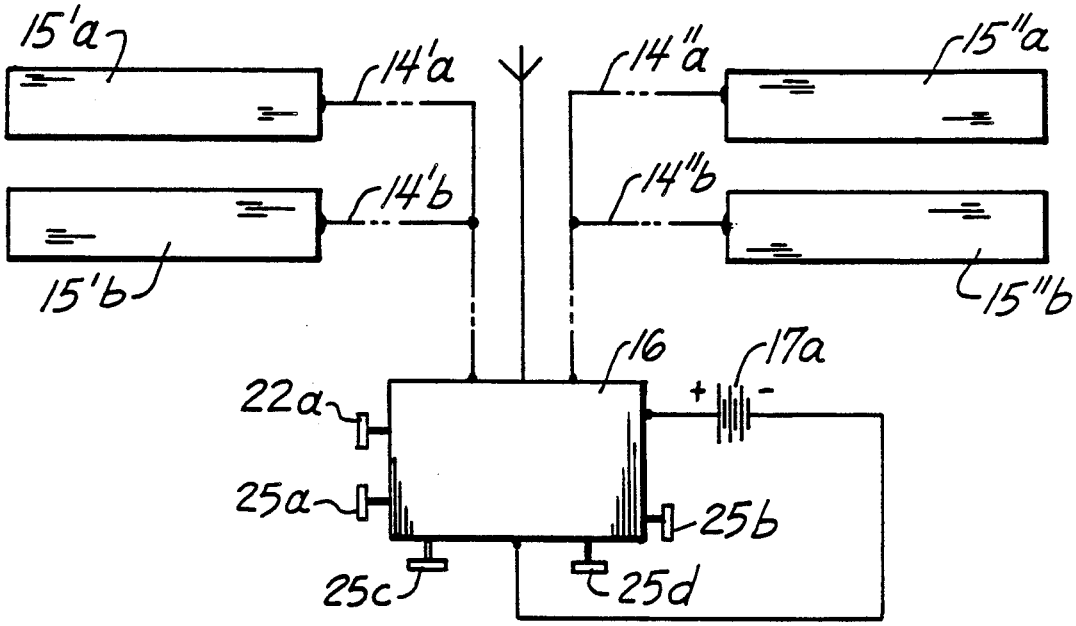

FIG. 7A diagrammatically illustrates the preferred tape transducers also illustrated in prior figures, here shown typically in elevation plan view with the lead wire therefrom leading to the graphically illustrated transmitter with manual control, and the connected battery or power source, typically four transducers being shown as representing the toe and heel of each of a pair of tapping shoes.

FIG. 7B diagrammatically illustrates the receiver, amplifier and speaker mechanisms for receiving, amplifying, and reproducing the signals and/or impulses received from the transmitter of FIG. 7A, and showing a power source.

FIG. 8 illustrate in perspective view, a typical mounting belt wearable around the waist of a performer, carrying the transmitter and battery and showing in-part the lead wire to the transducer(s).

FIG. 9 illustrates a pair of gloves in-part view with transducers mounted in different fingers, with the taps in contact.

In the illustrative above-noted Figures, for common elements shown in different Figures, the same indicia are utilized.

Broadly the invention may be defined as a shoe-tap and audio-sound transducer pick-up adapted for the transister to be sufficient contact with the shoe-tap as to pick-up vibrations and sound thereof and therefrom when the tap is struck against a hard surface.

The above-combination is in the form of various taps for the toe and for the heel respectively of each of a pair of shoes, or for one thereof, or alternatively mountable on one or more fingers of one or more gloves that may be worn by a dancer or rythym person such as a drummer, for tapping his feet and or fingers on one or more hard surfaces.

With reference to the Figures, FIGS. 1 through 6 represent a common embodiment of the invention, shown in different views.

More particularly, FIG. 1 represents a pair of tap-shoes embodying the present invention as right and left shoes 9*a* and 9*b* respectively, having toe taps 10*a* and 10*b* and heel taps 11*a* and 11*b* respectively, on the respective shoe soles 12*a* and 12*b* and heels 13*a* and 13*b*. Lead 14*a* and lead 14*b* each represent common or composite lead(s) from one or more transducers, i.e., there may be separate wires from each of the transducers of toe and heel. The lead(s) 14*a* and 14*b* are shown only in-part.

Figure 4:
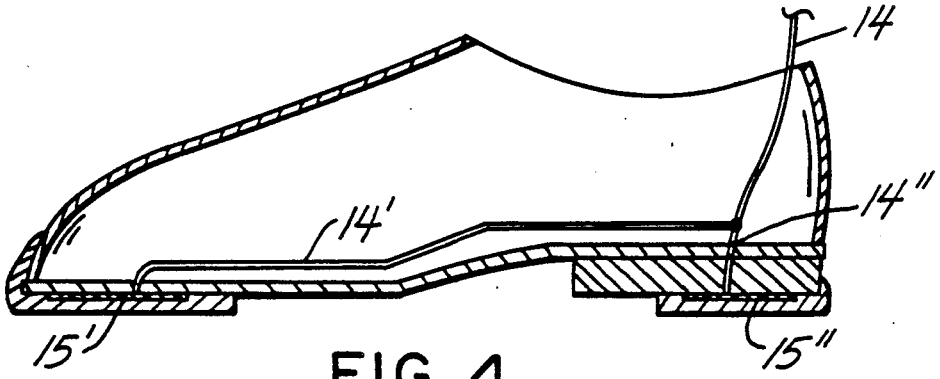
FIG. 4 illustrates a view as taken along line 4—4 of FIG. 3, diagrammatically showing in cross-section the shoe and tap and heel, and showing the mounted and positioned transducer and typical circuitry leads therefrom shown in-part, for each of the toe tap and the heel tap.
Figure 5:
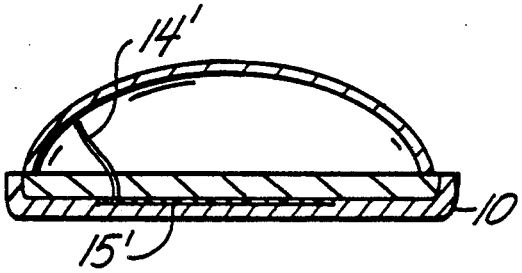
FIG. 5 illustrates a view as taken along line 5—5 of the FIG. 3, again diagrammatically showing in cross-section the shoe and toe tap and showing the mounted and positioned transducer and typical circuitry leads therefrom shown in-part.
Figure 6:
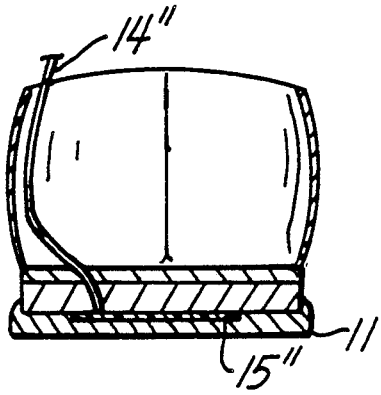
FIG. 6 illustrates a view as taken along line 6—6 of the FIG. 3, again diagrammatically showing in cross-section the shoe and heel tap and showing the mounted and positioned transducer and typical circuitry leads therefrom shown in-part.

FIGS. 2 through 6 represent typically either of the left or right shoe of FIG. 1 embodiment. As may be seen in the bottom view of FIG. 3, and the side view of FIG. 2, the taps are mounted in a conventional manner, with the exception that as shown in FIGS. 4 through 6 in this embodiment the leads are channeled through the sole or body of the shoe so as to not be visible from an exterior. However, it is with the contemplation of the invention to have such leads either inside or outside, or within the body of the shoe itself. The various leads of the toe and heel in these figures are shown as 14, 14', and 14''. The transducer is illustrated in each of FIGS. 4 through 6, shown positioned against the upper surface and in contact with the respective taps, as transducers 15'and 15'', in this embodiment being shown as a preferred tape-form transducer in combination with the tap and shoe. The tape is conveniently applied to the upper surface of the respective tap(s) which is then mounted on the sole of the shoe or bottom surface of the heel. Alternatively the transducer(s) may be mounted on or within the shoe-sole and/or shoe-heel lower surface, but in all cases such that the transducer is pressed into contact with the tap itself so as to pick-up the vibrations and sound when the tap(s) is/are tapped upon a hard surface.

FIG. 7A illustrates a typical sub-combination of the invention, inclusive of the toe and heel transducers of a pair of tap-shoes, as transducers 15'*a*, 15'*b* and 15''*a* and 15''*b*, with their respective leads 14'*a*, 14'*b*, 14''*a* and 14''*b*, all leads being connected to a transmitter 16 with its battery source 17*a*. Because the power output of different transducers designed to have consistent or the same output does in fact vary from one to another, there are included within and/or as a part of the transmitter unit, or separate therefrom, regulators to downgrade the signal of more powerful out-of-balance signals, and/or upgrade signals below level, and such mechanism is represented in FIG. 7A as manual control-knobs 25*a*, 25*b*, 25*c* and 25*d* for the four transducers 15'*a* and 15'*b* and 15''*a* and 15''*b*. Also, for increasing or decreasing the level of output, i.e. loudness or softness of each or one or all of the various signals, is the volume control mechanism and control knob 22*a*, such volume control being illustrated as a part of the amplifier mechanism 16. The FIG. 7A illustrates diagrammatically in plan view of the flat face of the transducer tapes.

FIG. 7B represents the separate signal(s) receiver 18 and volume-control mechanism illustrated to be a part thereof with its control knob 22*b* for controlling or adjusting volume. The signal(s) is/are fed into amplifier 20 having an appropriate power source 17*b* and the amplified signal is directed to one or more speakers 21. Receiver-applifier lead(s) 19 carries signals to the amplifier 20.

FIG. 8 illustrates a preferred embodiment of the mechanism of FIG. 7A, not illustrating the transducers, but showing the lead 14 from the transducers, and the transmitter 16 and battery-pack 17, all mounted on the belt 23 with its adjustable belt-buckle 24 for wearing around the waist of the dancer or performer.

FIG. 9 illustrates a pair of gloves, shown in partial cut-away, with separate transducers 115*a* and 115*b* mounted in separate fingers of one glove, and separate transducers 115*c* and 115*d* mounted in separate transducers of the other glove, with the leads therefrom shown in-part.

While not illustrated, the signal may be modified by any conventional or other electronic equipment as may be desired to obtain or achieve special effects, such as for example using a synthesizer in series between the FIG. 7B receiver 18 and the amplifier 20 within the lead(s) 19.

It is within the scope of the invention to make such variations as would be obvious to a person of ordinary skill, including substitution of equivalents and the like.

Likewise, while a preferred audio-sound pick-up transducer of this invention is in tape form typically known as a C-ducer (trademark) sold typically by C-Tape Development Ltd., any conventional or desired equivalent transducer may be utilized, such transducer material working on the principle of being a piezo-electric material such as the piezo-electric-type flattened tape of the C-ducer tape. Likewise, other electronic elements of this invention are well-known elements, the invention(s) being in the various combination(s) for this inventor's utility.

Prior art of any relevance was not found by a preliminary patentability search, typical patents being U.S. Pat. No. 4,043,241 to Hsing-Ching Liu including an electronic speacker system embodied within a shoe having alternate musical sounds produceable by different keys being pressed while walking in the shoes, and U.S. Pat. No. 3,702,999 to Gradisar for setting-off an audible speaker-alarm when a predetermined pressure on the shoe is exceeded by the wearer of the shoe, and U.S. Pat. No. 2,320,560 to Braddock to a button-shoe sole activator activating a mechanical bell when walking in the shoe.

I claim:

1. A tap-shoe device comprising in combination: a shoe-like element mountable on the foot of a human being, and a audio-pickup transducer mounted on said shoe-like element positioned thereon such that when the shoe-like element is tapped or struck upon a hard surface as to produce a tap-noise, the tap-noise will be picked-up by said audio-pickup, and an electronic radio-wave transmitter and power-source means connected to said audio-pickup transducer adapted to send-out a signal pick-up by the audio pickup transducer; and operatively connected to the audio pickup transducer, and spaced-from said electronic radio-wave transmitter and power-source a radio-wave receiver, amplifier and speaker means for receiving and amplifying and reproducing sound from said signal.

2. A tap-shoe device of claim 1, including a pair of said shoe-like element, one shaped and adapted for a left foot and another shaped and adapted for a right foot, each with a separate said transducer.

3. A tap-shoe device of claim 2, including at-least one tap mounted on each said one and said another shoe-like elements, and at least one of said transducer mounted in juxtaposition to each said one tap to pickup tapping sounds therefrom, each transducer being operatively connected to transmit signal to said electronic radio-wave transmitter and power source means.

4. A tap-shoe device of claim 3, in which each said transducer includes a piezo-electric-type flattened tape.

5. A tap-shoe device of claim 4, including one tap at a toe position of each shoe-like element with a first said transducer in juxtaposition thereto, and including another one tap at a heel position of each shoe-like element with a second said transducer in juxtaposition thereto.

6. A tap-shoe device of claim 1, in which said transducer includes a piezo-electric-type flattened tape.

7. A tap-shoe device of claim 6, including circuitry means for carrying electrical signals from each said transducer to said electronic radio-wave transmitter and power-source means.

8. A tap-shoe device of claim 5, including circuitry means for carrying electrical signals from each said transducer to said electronic radio-wave transmitter and power-source means.

9. A tap-shoe device comprising in combination: a tap suitable for mounting on a tap-shoe and a receiver and amplifier means of radio signal sendable by an audio-pickup transducer means, and said audio-pickup transducer means adapted for mounting in contact with said tap, such that a tap-sound from a tapping of the tap is picked-up by the audio-pickup transducer means and transmitted to and received and amplified by the receiver and amplifier means.

* * * * *